United States Patent [19]

Kitazawa

[11] 4,183,181

[45] Jan. 15, 1980

[54] APPARATUS FOR SUPPORTING A GRINDING ROLL

[75] Inventor: Noboru Kitazawa, Urawa, Japan

[73] Assignee: Soky Giken Kogyo Kabushiki Kaisha, Saitama, Japan

[21] Appl. No.: 831,516

[22] Filed: Sep. 8, 1977

[30] Foreign Application Priority Data

Jun. 3, 1977 [JP] Japan ..... 52-65498

[51] Int. Cl.[2] ..... B24B 7/12; B24B 45/00; B24B 53/04

[52] U.S. Cl. ..... 51/75; 51/5 D; 51/80 A; 51/168

[58] Field of Search ..... 51/5 D, 22, 23, 38, 51/75, 80 A, 168; 125/11 CD

[56] References Cited

U.S. PATENT DOCUMENTS

| | | | |
|---|---|---|---|
| 1,268,624 | 6/1918 | Riley | 125/11 CD |
| 1,664,693 | 4/1928 | Littler | 125/11 CD |
| 1,722,724 | 7/1929 | Wegner | 125/11 CD |
| 2,365,480 | 12/1944 | McArthur | 51/23 |
| 2,601,290 | 6/1952 | Hopkins | 125/11 CD |
| 2,759,301 | 7/1956 | Valette | 51/75 X |
| 4,019,282 | 4/1977 | Cauffiel | 51/75 |
| 4,073,281 | 2/1978 | Asaeda | 125/11 CD |

FOREIGN PATENT DOCUMENTS

| | | | |
|---|---|---|---|
| 115685 | 8/1941 | Australia | 51/75 |

*Primary Examiner*—Nicholas P. Godici

[57] ABSTRACT

A steel strip grinding machine for the continuous grinding of the upper and lower surfaces of steel strips includes a pair of vertically displaceable spindles into which the grinding rolls are journalled. One of the spindles is slidable axially whereas the other spindle is fixedly secured in the machine frame. The grinding rolls are thus removable through sliding of the axially slidable spindle without having to disassemble any bearings. The lower grinding roll is supportable on a lift truck mechanism for movement in and out of the machine frame whereby removal of such grinding roll for the lower surface of the steel strip can be effectuated without use of a crane. Further, a device for dressing the outer peripheral surface of the grinding roll is provided adjacently to the grinding roll. The grinding roll is made by spraying a thermosetting resin containing hone grains upon a nonwoven fabric in which filaments are entangled at random. Its shaft is formed to be hollow. The above mentioned spindle is so formed as to be engaged at the tip with each end of the shaft.

8 Claims, 10 Drawing Figures

36
38
37
39
35

APPARATUS FOR SUPPORTING A GRINDING ROLL

DESCRIPTION OF THE INVENTION

The present invention relates to apparatus for continuously grinding various kinds of steel strips on both surfaces and, in particular, to the grinding rolls for use therein which are easy to replace when worn; wherein the grinding roll for grinding the lower surface of the steel strip is easy to replace; wherein the grinding is always made under a constant pressure; and to provision of a grinding roll which is uniform in hardness about its outer peripheral surface, is durable, is easy to assemble and can be used to grind various kinds of steel strips.

In conventional apparatus for continuously grinding various kinds of steel strips on both surfaces, a shaft projects from each end of the grinding roll and is obviously borne by a bearing formed in a frame. However, there have been defects in that when the grinding roll is worn and must be replaced, it was necessary to remove the bearing formed in the frame. This entailed much effort to remove the roll, causing operation of the machine to be interrupted for long periods of time. It has been particularly difficult to replace the grinding roll for grinding the lower surface of the steel strip.

That is because a backup roll is positioned above the grinding roll for grinding the lower surface of the steel strip. In order to replace the grinding roll, it has been necessary to first remove the backup roll from the frame, then remove the bearing grinding roll from the frame and support the grinding roll with a crane.

Further, in the conventional apparatus, when a steel strip or the like is ground by being passed between the grinding roll and backup roll, the grinding roll will be worn for only the width of the strip and unworn parts will remain on both end parts of the grinding roll. If the grinding operation is continued in this condition, the above mentioned unworn parts will contact the backup roll, the strip will be no longer ground and the grinding operation will have to be interrupted. In case the strip is thin, such trouble will frequently occur. In such case, the operation has been stopped, the grinding roll has been removed and the above mentioned unworn parts have been removed. However, there have been defects that many troubles are required and the operation must be interrupted, the grinding roll has to be removed and the above mentioned unworn parts have to be removed, all taking a long time.

It is an object of the present invention to eliminate such defects as are mentioned above.

A primary object of the present invention is to make it possible to replace only the grinding roll without need to remove the bearing for it from the form frame.

According to the present invention the grinding roll is supported by a pair of axially spaced spindles, each of which is journalled, in a vertically movable bearing part located on each side of a frame. One of the spindles is axially slidable together with a bearing part, but the other spindle is supported in a fixed bearing. The shaft of the grinding roll is hollow and without projection at its ends so that the tip of the respective spindles may be set into engagement with each end of said shaft.

Therefore, according to the present invention, one spindle is slidable together with its bearing to provide a clearance allowing the grinding roll to be separated from both spindles; thus, the grinding roll can be removed without removing the bearing and another new grinding roll can be fitted between both spindles.

A second object of the present invention is to provide for the replacement of the grinding roll for grinding the lower surface of a steel strip without removing a backup roll located above it.

According to the present invention, a truck having a lift mechanism is provided below the lower grinding roll which is able to be run out from beneath the frame. When the lower roll is to be replaced, the truck is moved to be below the grinding roll and the grinding roll is then lifted and supported by operating the lift mechanism, the lower grinding roll supported as above described is removed from both spindles by sliding one spindle depositing the roll on the lift so that it may be carried out of the frame by the truck. Further, another new grinding or replacement roll can be fitted between both spindles by reversal of the truck.

Another object of the present invention is to provide for continuous operation by automatically removing unworn parts left on the end parts of the grinding roll during the grinding operation with the grinding roll.

Therefore, in accordance with the present invention, there is associated with each grinding roll cutters for removing the unworn parts. These cutters are adapted to scrape off the unworn parts left at each end, reducing the ends in conformity with the worn part of the grinding roll. The cutters slide in the length wise direction of the grinding roll while rotating.

The above mentioned and other objects, features and advantages of the present invention will become clear from the following detailed explanation of an embodiment of the invention and from the accompanying drawings in which.

Figure 1:
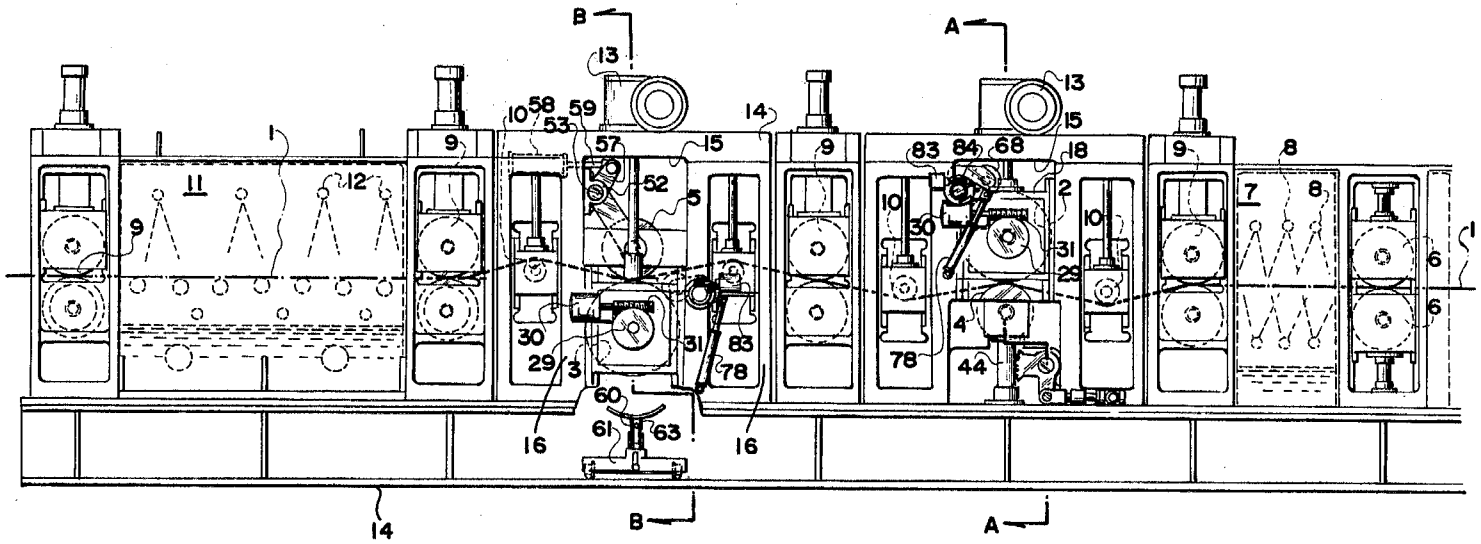
FIG. 1 is a side elevational view of an apparatus for grinding various kinds of steel strips according to the present invention.

A grinding apparatus according to the present invention is shown in FIG. 1. The present invention, as stated earlier, is most particularly adapted for the continuous grinding of steel strips. In FIG. 1, numeral 1 indicates a steel strip, 2 indicates a grinding roll for grinding the upper surface of the strip, 3 indicates a grinding roll for grinding the lower surface of the strip, 4 indicates a backup roll for the grinding roll 2, 5 indicates a backup roll for the grinding roll 3, 6 indicates a pair of a superposed brush rolls, 7 indicates a washing tank, 8 indicates a series of shower heads provided in the washing tank, 9 indicates a pair of pinch rolls, 10 indicates a tension roll, 11 indicates a hot rinse tank, 12 indicates a series of shower heads provided in the hot rinse tank and 13 indicates an reversible electric motor to provide power for the vertical movement of each of the above mentioned grinding rolls 2 and 3.

The strip 1 which normally has dirt deposited on both surfaces is passed through the brush rolls 6. The strip is then liquid-washed in the washing tank 7 and is passed through the pinch rolls 9 and tension roll 10, to be ground on the upper surface between the grinding roll 2 and its associated backup roll 4. After this step, the strip is ground on its lower surface between the grinding roll 3 and its associated backup roll 5 in the same manner. The grinding dust and the like is washed off in the hot rinse tank 11, being removed through the pinch rollers 9 to be painted on the ground surfaces with an antirust oil or the like and wound up to be in the form of a coil (neither of which is illustrated.)

The supporting devices and driving devices respectively for the grinding rolls 2 and 3 according to the present invention shall now be explained. The supporting device and driving device for the grinding roll 3 are substantially identical with those for the grinding roll 2 and therefore can be simultaneously described.

Figure 2:
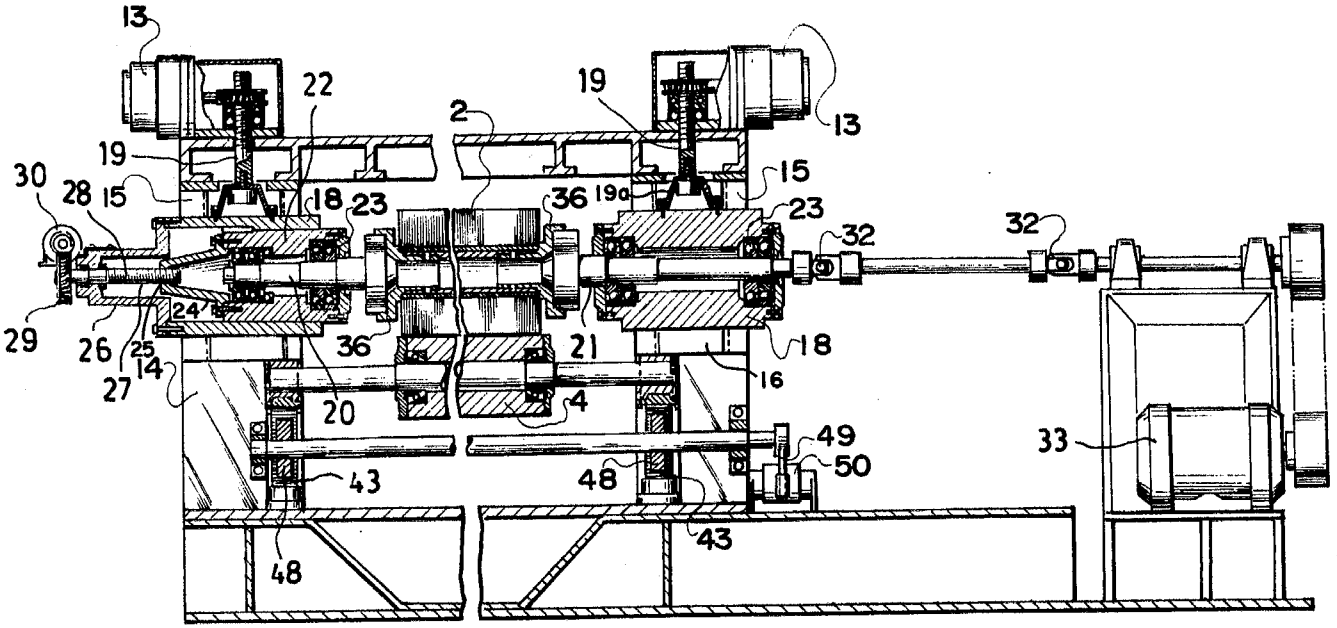
FIG. 2 is a sectional view taken along line A—A of FIG. 1.
Figure 4:
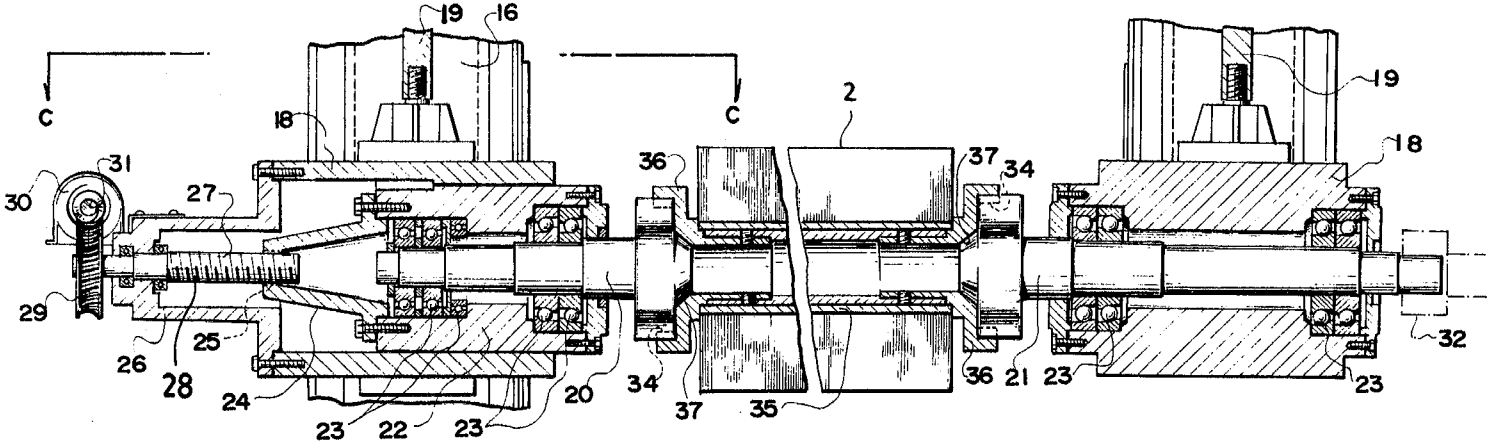
FIG. 4 is an enlarged sectional view of the mentioned bearing parts shown in FIG. 2.
Figure 5:
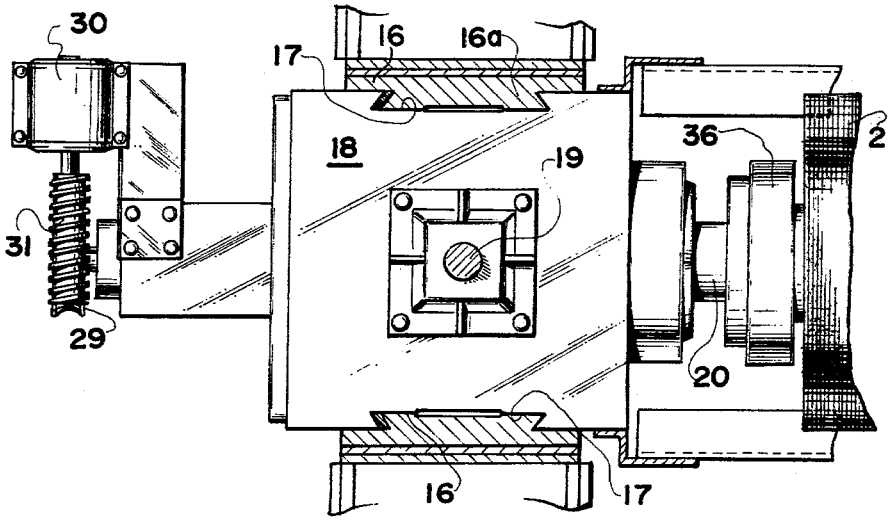
FIG. 5 is a sectional view taken along line C—C of FIG. 4.

The apparatus is housed in a frame 14 having side walls in which window holes 15 are provided in the positions on both sides corresponding at least to the location of the grinding devices. Inside the respective window holes 15 are mounted opposed vertical standards 16 which are provided with a projecting dove-tail key 16*a* extending along their length, as seen in FIGS. 2, 4, & 5. A metal chock 18 having a conforming spline, formed respectively on both sides by recessed grooves 17 slidably intermeshing with the key 16*a*, and is fitted between the opposed standards 16. That is to say, the metal chock 18 is so provided as to be movable in the vertical direction within the window hole 15 but to be immovable in the horizontal direction. The metal chock 18 is moved in the vertical direction by the reversely rotatable electric motor 13 provided on the upper frame 14.

Figure 3:
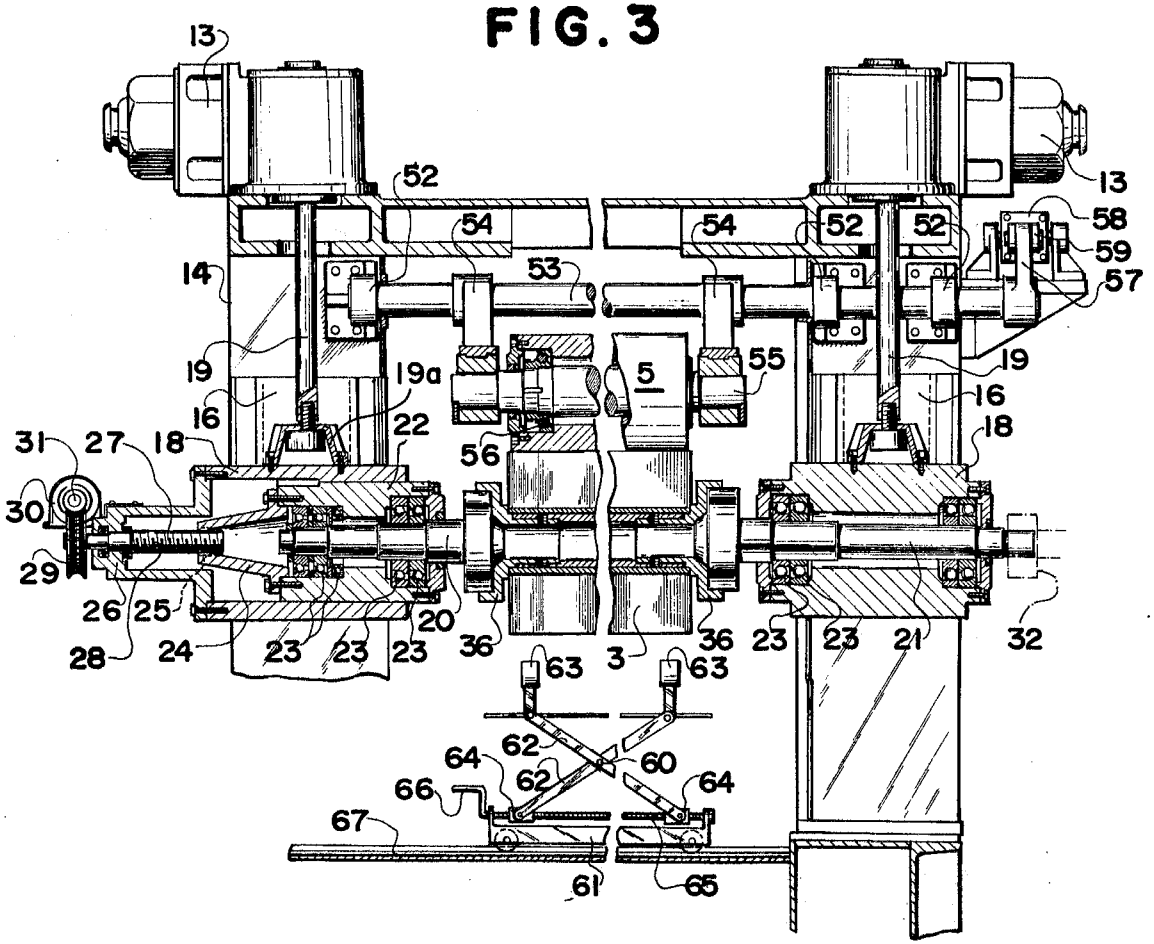
FIG. 3 is a sectional view taken along line B—B of FIG. 1.

As seen in FIG. 3 a threaded hanging rod 19 connects each of the metal chocks 18 to the motors 13. Each rod 19 is provided at its lower end with a head and extends freely through a bracket 19*a* secured to the top of the chock 18, and extends upwardly through the threaded center of a ring gear driven by the motor 13. On the other hand, the motor shaft may be provided with a pawl rotating the rod which rotates in the chock to lift it. The metal chocks 18 are provided respectively with spindles 20 and 21 as shown in FIGS. 2–4.

The spindle 20 is mounted so as to be slidable relative to the chock 18, but the spindle 21 is mounted so as to be rotated and driven in a fixed position axial relative to its chock. The spindle 20 is journalled in a bearing part 22. Connected to the axial outer rod of the bearing part 22 is a conical member 14 in which is formed a female screw hole 25. A cover 26 is provided on the metal chock 18 enclosing the conical member 24. A male screw rod 27 is rotatably fitted to said cover 26, the tip of which is screwed within the female screw hole 25 provided in the above mentioned conical member 24.

Further, a worm gear 29 is secured to the outside end of the male screw rod 27 and a normally and reversely rotating motor 30 is mounted on the cover 26 having a worm 31 formed on its rotary shaft meshing with the above mentioned worm gear 29.

Therefore, the male screw rod 27 can be rotated normally and reversely by the motor 30 so that the male screw rod 27 can be rotated to reciprocably slide the bearing part 22 horizontally and, at the same time, carrying the spindle 20 within the bearing part 22.

The fixed spindle 21 is journalled in a pair of bearings 23 mounted within the metal chock 18 so as to be rotated and driven without being moved horizontally. As shown in FIG. 2, the spindle 21 is provided with a universal jointed connecting rod 32 at its outer end which is rotated and driven by a motor 33.

Figures 9, 10:
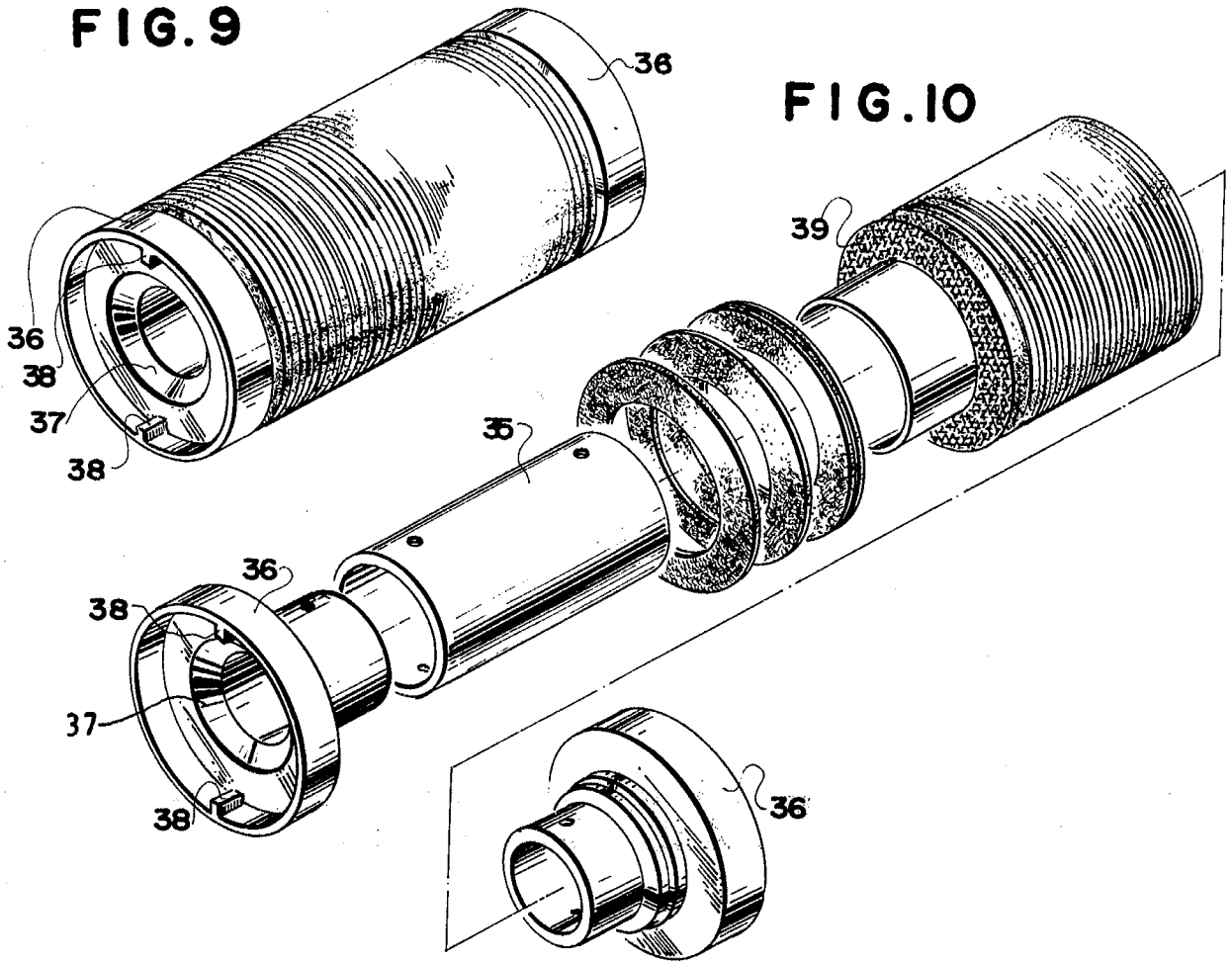
FIG. 9 is a perspective view of the grinding roll of the present invention.
FIG. 10 is a disassembled view of the grinding roll.

The inner end of each of the spindles 20 and 21 is tapered and is provided with a preformed head 34 having a plurality of axial slots spaced about its periphery so that it can fit within and engage with each end part of the respective grinding rolls, which is formed with a cup-shaped end 36 having inwardly meshing keys 38, as seen in detail in FIGS. 9 & 10.

The grinding rolls 2 and 3 are mounted about a hollow shaft 35 at the ends of which the cup-shaped head 36 is fixed. The cup-shaped head 36 receives the inner end of the respective spindles 20 and 21 and are provided respectively with recesses 27 opposed to the inner ends of the above mentioned spindles 20 and 21. The grinding rolls 2 and 3 are formed of a stack of annular plates prepared by spraying a thermosetting resin mixed with hone grains upon a felt-like nonwoven fabric in which filaments are entangled at random as shown in FIG. 10 and punched to be doughnut-shaped as seen in the same drawing. A proper number of such punched doughnut-shaped plates are fitted to the shaft 35 and compressed between the end cups 36. In stacking the plates, nets 39 made of a synthetic resin or metal are interposed in proper positions among them and they are dried as pressed and heated from both sides.

When nets 39, made particularly of a metal as hard as or lower in hardness than the above mentioned hone grains, are used, beneficial effects of elevating the durability of the grinding roll and keeping the hardness of the outer peripheral surface of the grinding roll constant, are obtained.

Figure 6:
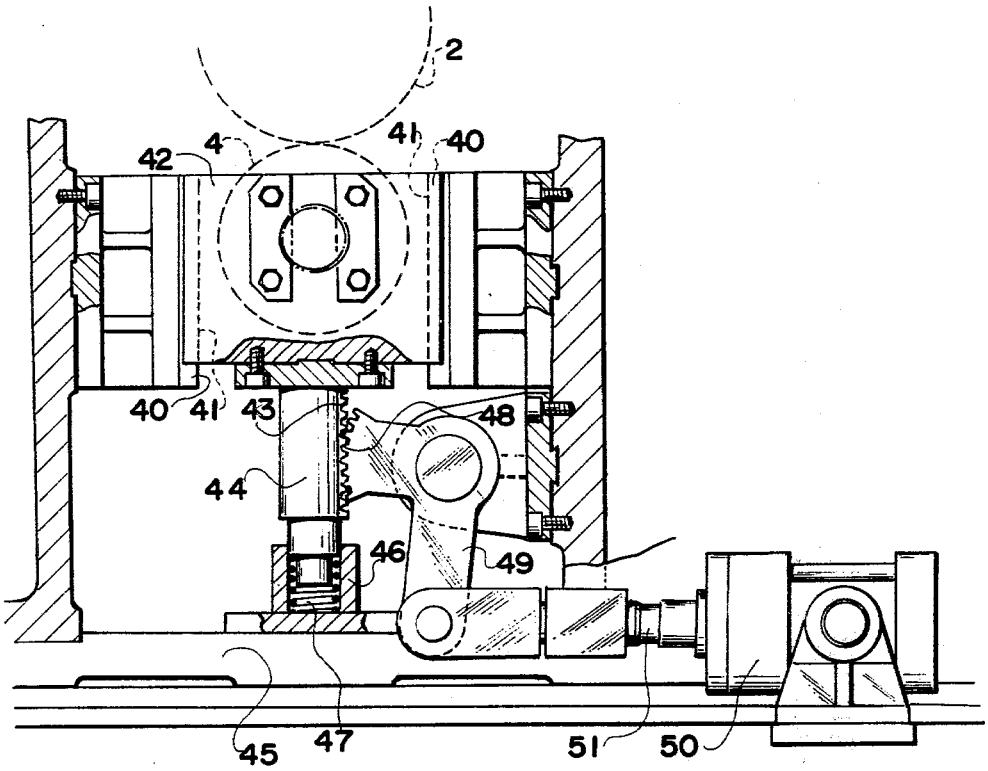
FIG. 6 is a partly sectioned side view of the backup roll support shown in FIG. 2.

The backup rolls 4 and 5 shall be explained. As shown in FIGS. 1 and 6, a second set of vertical standards 40, that are dovetailed, are mounted inside the window holes 15 formed in the frame 14 in that portion adjacent the back up rollers. Metal chocks 42 having recessed grooves 41 fitting the dove-tail projections are fitted between the standards 40. The backup roll 4 of the grinding roll 2 for grinding the upper surface of the strip 1 is rotatably about a supporting shaft, secured at each end between the metal chocks as shown in FIG. 2.

A movable supporting jack 44 having a rack 43 on the side is provided below the metal chock 42 and is inserted at its lower end into a boss 46 formed on a base 45 of the frame 14. A compression spring 47 is interposed between the boss 46 and supporting rod 44.

A pinion 48 meshing is borne on an elongated shaft to which a bracket 49 is fitted. The bracket 49 is connected to the rod 51 an oil pressure cylinder 56 so as to enable the pinion 48 to reciprocate rack 43.

On the other hand, the backup roll 5 of the grinding roll 3 for grinding the lower surface of the strip 1 is mounted somewhat differently. As shown in FIGS. 1 and 3, a rotatable shaft 53 is linked by fixtures 52 on one side of each window hole 15 above the grinding roll 3. Two arms 54 are provided downwardly at a proper spacing on said shaft 53, and another shaft 55 is fitted to the lower ends of the arms 54, journalled on the shaft 55 by bearings 56.

Further, a bracket 57 is provided at one end of the above mentioned shaft 53 and is pivoted by a piston rod 59 of an oil pressure cylinder 58.

In FIG. 3, a scissor-type truck 61 having a lift 60 is provided below the grinding roll 3 and is pounded with wheels so as to be able to be run transversely out of the frame 14.

The lift 60 comprises supporting rods 62 crossed with each other and pivoted in the crossing part, and having at its upper ends grinding roll receiving cradle 63. The supporting rods 62 are moved by bosses 64 provided at their lower ends of the supporting rods 62. The boss 64 having a female screw bore within it through which screw 65 having a handle 66 extends.

Screws reverse to each other are formed respectively on the parts of the screw 65 on which the bosses 64 at both ends are to be screwed so that, by rotating the screw 65 with the handle 66, the spacing of the bosses 64 may be freely changed toward and away from each other and therefore the receiving part may move vertically.

Further, the truck 61 is mounted on rails 67 extended out of the frame 14 so as to be able to be run transversely out of the frame 14.

Figure 8:
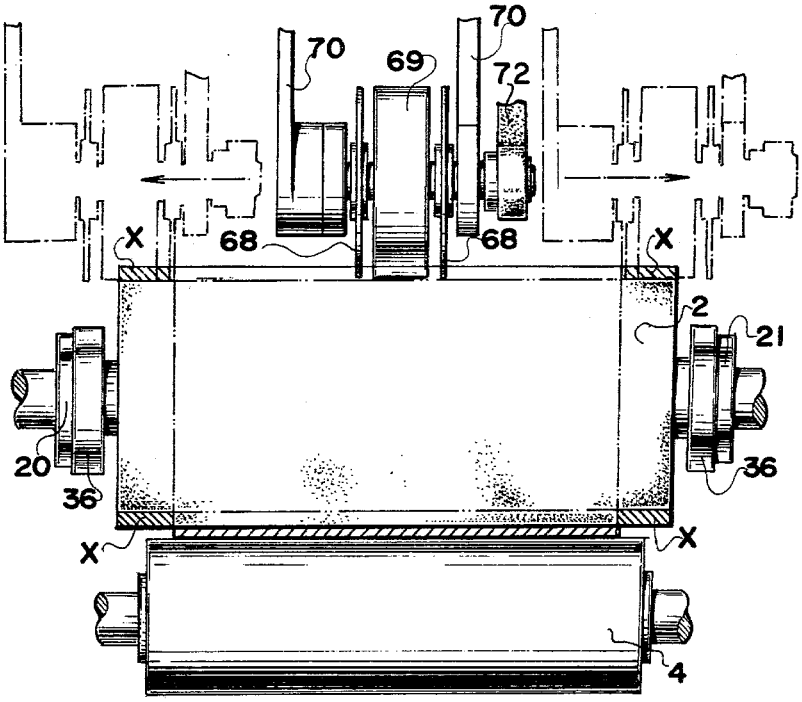
FIG. 8 is an end view showing the dressing action of the device of FIG. 7.
Figure 7:
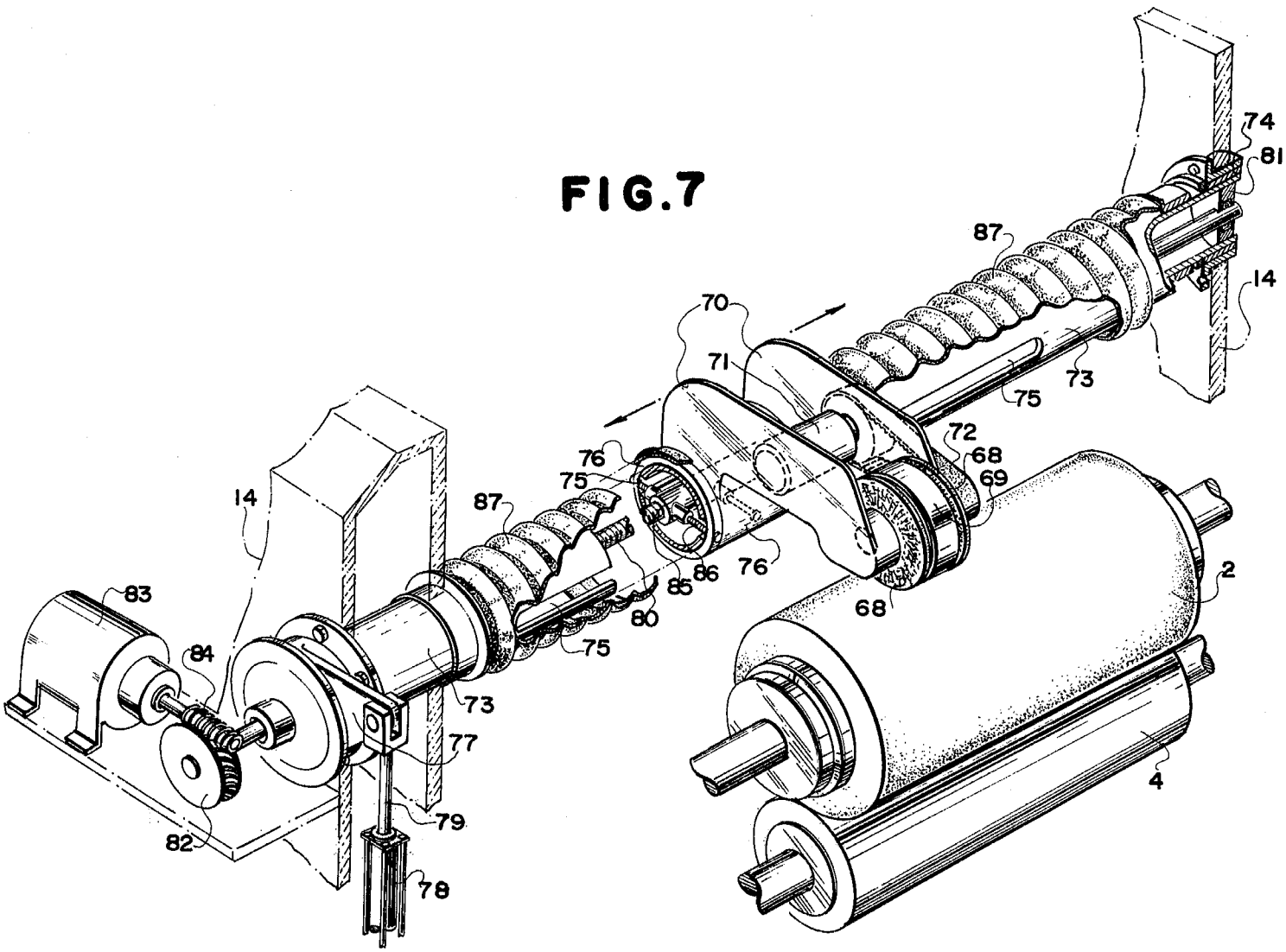
FIG. 7 is a perspective view partly in section of a dressing device.

A dressing device for the grinding rolls is shown in FIGS. 7 and 8.

When a strip is ground between the grinding roll and backup roll, which is narrower than the grinding roll and backup roll, the grinding woll will be worn only for the width of the steel strip, and both ends of the grinding roll will remain unworn. After continued grinding, the grinding roll will contact the backup roll, and the strip will be no longer ground.

This fact shall be explained with reference to FIG. 8. The grinding roll 2 will be worn only in the part contracting the steel strip 1 and will be gradually reduced in the diameter leaving the remaining portions unworn on both end parts X (shown by hatches for the convenience). These end portions X will contact the backup roll 4 sooner or later and will grind said backup roll, and thus the steel strip 1 will be no longer ground.

The dressing device of the present invention is so formed that the unworn parts produced on both ends of a grinding roll may be scraped off in conformity with the wear of the grinding roll accompanying the grinding of a steel strip and the entire grinding roll may be always of the same uniform diameter. Further, such scraping is made during the strip grinding operation and it is not necessary to interrupt the operation in order to remove the unworn parts of the grinding roll.

In the dressing device of the present invention, two cutters rotated at varied speeds are kept in contact with the peripheral surface of the grinding roll and are slid in parallel with the grinding roll to scrape off the above mentioned unworn parts, a roll of the same diameter as of the cutters is provide between the two cutters so that no more scraping than is required need be made. A mechanism for automatically pressing the two cutters and roll against the grinding roll and for sliding them in parallel with the grinding roll are provided.

Its details are shown in FIG. 7 wherein numeral 68 indicates a cutter having a scraping effect on the side surface. A roll 69 is provided between the cutters 68. The cutters 68 and roll 69 are coaxial with each other and are provided at the tips of arms 70.

Further, the arms 70 are provided with an electric motor 71 by which the above mentioned cutters 68 and roll 69 are rotated through a belt 72.

Numeral 73 indicates a pipe supported at both ends on the frame 14 through bearings 74 and is so formed as to rotate in a certain range.

Further, a slot 75 longer than the grinding roll 2 is provided on each side of the central portion of the pipe 73 and a boss 76 is secured to the inner ends of the above mentioned arms 70 is fitted about the pipe 73 to be slidable across to pipe 73.

A crank 77 is secured to one end of the pipe 73 and to a piston rod 79 of an air cylinder 78 provided separately on the frame 14.

Further, a screw 80 is provided within the pipe 73, and is supported at both ends within bearings 81 provided within the pipe 73. The screw so projects at one end out of the pipe 73 and has a worm gear 82 secured thereto. A reversely rotating electric motor 83 is provided on the frame 14 and a worm 84 formed on its rotary shaft meshes with the above mentioned worm gear 82. A second boss 85 having a female screw bore formed in a central through hole is located on the screw 80. The boss 85 and the boss 76 secured to the inner end of the arm 70 are connected with each other through a bolt 86 which stands radically through the slot 75. In the drawing, numeral 87 indicates a cylindrical bellows covering the pipe 73 so that no dust may enter the sliding part.

In the dressing device of the above mentioned formation, when the pipe 73 is rotated toward the grinding roll 2 by operating the air cylinder 78, the cutters 68 and roll 69 will be pressed against the grinding roll 2. When the screw 80 is rotated by the reversely rotating motor 83, the cutters 68 and roll 69 will slide parallel to the axis of the grinding roll 2.

As shown in FIG. 8, the cutters 68 and roll 69 will be pressed against the grinding surface of the grinding roll 2 the sliding width will be so controlled that the entire movement will not permit it from deviating either end of the grinding roll and the unworn parts produced at both ends of the grinding roll at the time of the grinding operation will be scraped off.

The preferred embodiment of the present invention has been explained in detail in the above. However, this explanation describes only an embodiment and the present invention is not to be limited thereto.

What I claim is:

1. Apparatus for supporting a grinding roll of a strip metal grinding machine comprising a frame, a pair of axially aligned spaced spindles adapted to respectively engage opposite ends of the grinding roll placed therebetween, bearing means for journalling each of said spindles for rotation about its central axis, chock means for housing each of said bearing means within said frame, said chock means being movable within said frame perpendicular to the axis of rotation, one of said bearing means being slidable axially within its chock means so as to carry the spindle journalled therein axially toward and away from the other of said spindles to thereby enable engagement with and separation of said spindles from a roll placed therebetween.

2. The apparatus according to claim 1 wherein each of said chocks is located within a vertical window formed on an opposing wall member of said frame, said chocks and said window having cooperating key means for securing said chock therein for vertical movement.

3. The apparatus according to claim 2 including motor means and transmission means connecting said motor to said chock means for movably supporting said chock means within said window.

4. The apparatus according to claim 1 including shaft means for said grinding roll, said shaft means having at its outer end a radially extending flange having a recess for receipt of said spindle, said recess and said spindle having key means cooperating to permit conjoint rotation of said shaft and spindle on engagement thereof.

5. The apparatus according to claim 1 wherein said one of said chocks housing said slidable spindle, comprises an outer housing member mounted to be slidable with respect to said frame, and an inner housing member fixedly supporting the bearing means for said spindle, said inner housing member being mounted to be slidable with respect to the outer housing member.

6. The apparatus according to claim 5 including means for selectively adjusting the position of said inner housing within said outer housing.

7. The apparatus according to claim 1, including truck means movable into and out of said frame beneath said grinding roll, said truck means having a collapsible lift mechanism for extension into engagement with said grinding roll for support of said grinding roll when free of said spindle.

8. The apparatus according to claim 7, including rail means for support of said truck.

* * * * *